US006877443B2

(12) United States Patent
Rivera et al.

(10) Patent No.: US 6,877,443 B2
(45) Date of Patent: Apr. 12, 2005

(54) KNOCK-DOWN TABLE

(75) Inventors: Richard Rivera, Garden Grove, CA (US); Gullermo Rodriguez, Rancho Cucamonga, CA (US); Moi V. Bui, Rancho Santa Margarita, CA (US)

(73) Assignee: Tropitone Furniture Co., Inc., Irvine, CA (US)

( * ) Notice: Subject to any disclaimer, the term of this patent is extended or adjusted under 35 U.S.C. 154(b) by 165 days.

(21) Appl. No.: 10/207,682

(22) Filed: Jul. 26, 2002

(65) Prior Publication Data

US 2004/0016376 A1 Jan. 29, 2004

(51) Int. Cl.[7] ..... A47B 13/00

(52) U.S. Cl. ..... 108/157.15; 108/157.1; 248/188.6

(58) Field of Search ..... 108/157.15, 157.16, 108/157.18, 157.17, 158.12, 153.1, 156, 157.1, 150, 27; 248/188, 188.7, 188.6

(56) References Cited

U.S. PATENT DOCUMENTS

| | | | | | |
|---|---|---|---|---|---|
| 795,957 | A | * | 8/1905 | Cartland | 312/265.1 |
| 1,800,685 | A | | 4/1931 | Griffis | |
| 1,997,660 | A | | 4/1935 | Smith | |
| 2,803,419 | A | | 8/1957 | Phillips | |
| 3,160,121 | A | | 12/1964 | Bedol | |
| 3,215,381 | A | | 11/1965 | Ching | |
| 3,242,887 | A | | 3/1966 | Haydock | |
| 3,267,889 | A | | 8/1966 | Bedol | |
| 3,366,079 | A | | 1/1968 | Koransky et al. | |
| 4,315,467 | A | | 2/1982 | Vanderminden | |
| 4,482,119 | A | | 11/1984 | Zelkowitz et al. | |
| 4,805,541 | A | * | 2/1989 | Drane et al. | 108/27 |
| 4,905,612 | A | * | 3/1990 | Apissomian | 108/157.15 |
| 5,404,828 | A | * | 4/1995 | Tesney | 108/27 |
| 5,791,264 | A | * | 8/1998 | McCraney | 108/151 |
| 6,006,679 | A | * | 12/1999 | Lin | 108/157.15 |
| 6,536,359 | B2 | * | 3/2003 | Liu | 108/118 |
| 6,553,921 | B2 | * | 4/2003 | Liu | 108/157.15 |

* cited by examiner

*Primary Examiner*—Jose V. Chen
(74) *Attorney, Agent, or Firm*—Knobbe, Martens, Olson & Bear, LLP

(57) ABSTRACT

A knock-down table that can be quickly assembled and disassembled for compact storage or shipping. The apparatus includes a table top, a plurality of detachable legs and a ring-shaped brace. Coupling members are provided on the bottom side of the table top and project downwardly therefrom. Sockets are formed in the top ends of the table legs for slidably receiving the coupling members. The ring-shaped brace interconnects each of the legs and maintains the structure in a substantially rigid configuration.

20 Claims, 11 Drawing Sheets

KNOCK-DOWN TABLE

BACKGROUND OF THE INVENTION

1. Field of the Invention

The present invention relates to a table that can be quickly and easily assembled or disassembled.

2. Description of the Related Art

Various table designs have been proposed for use in an outdoor environment such as on a lawn, patio or garden. Many of these tables are manufactured as a rigid unitary structure whereby the table top is permanently attached to the leg assembly through welding or other means. However, tables manufactured as a unitary structure are typically quite heavy and bulky. Furthermore, these tables cannot be disassembled and therefore require a large amount of storage space when not in use. These limitations present significant problems because it is often necessary to move or store outdoor tables due to changes in the weather or other factors.

Because of the problems associated with unitary table structures, numerous alternative table designs have been proposed whereby the table can be collapsed or disassembled for compact storage. Tables that can be assembled and disassembled by the owner are commonly referred to as "knock-down" tables. In recent years, knock-down tables have become increasingly popular, not only for their advantages with respect to compact storage, but also for the cost savings to the consumer. Manufacturers reduce costs by not expending resources to assemble the table in the factory and, in addition, the disassembled table is less expensive to ship because it can be transported in a smaller container. Therefore, in general, a disassembled table can be purchased at a lower price than a similar assembled table. It has been found that many consumers are more than willing to assemble an outdoor table themselves in order to take advantage of the cost savings.

Existing knock-down table designs take many different forms. One particular type is described in U.S. Pat. No. 1,800,685 to Griffis. This invention includes a leg assembly comprising two frame members hinged about a central axis. When unfolded, the frame members form an X-shaped leg assembly which provides the support structure for the table top. The table top is placed on top of the X-shaped leg assembly and dowel pins on the bottom of the table top fit into openings in the top surface of the frame members. A central locking bolt is provided to secure the table top onto the frame members.

Another type of knock-down table is described in U.S. Pat. No. 3,267,889 to Bedol. Specifically, this invention comprises a table top and a frame, or tripod, which can be used to support the table top in a horizontal plane. The frame, or tripod, consists of three elongated tubular legs of uniform diameter and length which are connected to each other, intermediate their ends, by an encompassing triangular collar. The table top rests on top of the frame, but the table top can be removed and the frame can be collapsed for compact storage.

Yet another knock-down table design is described in U.S. Pat. No. 4,315,467 to Vanderminden. This invention discloses a cocktail table comprised of a table top having a flat shape with a depending peripheral edge. A leg assembly is provided which includes three pivotally interconnected legs to support the table top. Each leg includes an outwardly directed portion that frictionally engages the peripheral edge of the table top. The legs are connected to each other and pivot with respect to each other thereby allowing the legs to be pivoted into a substantially flat configuration for shipping or storage.

Various other collapsible table designs and related inventions are disclosed in U.S. Pat. No. 1,997,660 to Smith, U.S. Pat. No. 2,803,419 to Phillips, U.S. Pat. No. 3,160,121 to Bedol, U.S. Pat. No. 3,215,381 to Ching, U.S. Pat. No. 3,242,887 to Haydock, U.S. Pat. No. 3,366,079 to Koransky, U.S. Pat. No. 4,482,119 to Zelkowitz, and U.S. Pat. No. 5,404,828 to Tesney.

Although numerous knock-down table designs have been proposed, none of the existing designs has been sufficient to provide all of the qualities desired in an outdoor table. Because of their various designs, each of the existing knock-down tables has one or more shortcomings, such as, for example, insufficient structural integrity, difficulty of assembly or disassembly, need for specialized tools or skills, excessive number of components, excessive weight, or bulkiness in design. No knock-down table has yet been discloses that satisfies all of the requirements for a convenient and durable outdoor table.

Thus, there remains a very real and substantial need for an improved knock-down table that can be quickly and easily assembled and disassembled. It is desirable that such a table be capable of being fully dismantled for shipping and compact storage in a substantially flat configuration. It is also desirable that such a table include a minimum number of parts and utilize pop-in components for convenience and ease of use. It is also desirable that such a table be constructed of lightweight materials that are resistant to corrosion. Finally, it is desirable that such a table be inexpensive to manufacture, be aesthetically appealing, and be versatile enough for a wide range of applications. The present invention addresses these needs.

SUMMARY OF THE INVENTION

The present invention provides a new and improved knock-down table that can be quickly and easily assembled and disassembled without the need for specialized tools or training. The knock-down table of the present invention is generally characterized by a horizontal table top, a plurality of legs and a brace for interconnecting each of the legs. The legs are attached to the table top using convenient pop-in components that provide a sturdy and rigid connection.

Coupling members are provided on the bottom side of the table top for coupling the leg assembly to the table top. In a first preferred embodiment, each coupling member comprises at least one pin extending downward from the table top. At least one socket is formed in the top end of each leg for receiving the pin(s). The pins slide into the sockets in a snug friction-fit relationship. The pins preferably extend at a downward and inward angle relative to the horizontal plane of the table top and therefore the table top is prevented from detaching from the leg assembly while the legs are in a fixed position. Furthermore, the weight of the table top serves to strengthen the connection between the table top and the legs by applying force to the connecting components and thereby ensuring that the pins cannot become inadvertently dislodged from the sockets. Therefore, this table design possesses a very high degree of stability in the assembled condition.

Each of the legs is attached to a ring-shaped brace located intermediate the ground and the table top. U-shaped brackets are provided along the inner surface of each leg for receiving the brace. The brace is coupled to the legs using allen bolts (i.e. bolts formed with alien sockets), however, other attachment means may also be used. When the brace is coupled to the legs, the legs are prevented from moving relative to each other and the leg assembly is maintained in a rigid configuration.

At least three legs are used in order to provide a stable support structure for the table top, however, the number of legs may vary. Each leg is preferably a substantially hollow elongated member having a rectangular cross-section. Ribs extend lengthwise through the inner hollow portion of each leg for added structural integrity and also to form the sockets for receiving the pins. The bottom end of each leg rests on the ground and is preferably covered by a cap fitting. The cap is made of a durable plastic to prevent sliding or skidding and also to protect the ground surface from being scratched or damaged.

The table top is preferably formed of component parts. The first component is a top ring with supports that extend across the ring. A surface member rests on top of the ring and supports and provides the primary surface for the table top. A flexible annular rim is placed over the surface member and top ring to maintain the table top in a rigid configuration.

The knock-down table apparatus may also take alternative forms which work equally as well. For example, in another preferred embodiment, the pins are provided in the top ends of each leg and extend upward therefrom. The coupling members on the bottom side of the table top are formed with sockets for receiving the pins. The table is assembled by inserting the pins in the legs into the sockets in the coupling members. In yet another preferred embodiment, each leg is formed with one pin and one socket and each coupling member is also formed with one pin and one socket. The pin from the coupling member is inserted into the socket in the leg and the pin from the leg is inserted into the socket in the coupling member.

The table components are preferably extruded and can be manufactured in an efficient manner by using the same extrusion for multiple components. For example, the legs, coupling members, supports, and brace may all be formed with identical cross-sections and hence may be conveniently cut from the same extrusion.

The table is described herein with particular reference to use in an outdoor environment such as on a lawn, patio or garden, however, it will be understood that the table is equally suitable for use in a home or commercial establishment.

Other features and advantages of the invention will become apparent from the following detailed description, taken in conjunction with the accompanying drawings, which illustrate, by way of example, the features of the invention.

BRIEF DESCRIPTION OF THE DRAWINGS

FIGS. 13A–13C are top views showing various examples of alternative table top shapes that can be used with the present invention.

DETAILED DESCRIPTION OF THE PREFERRED EMBODIMENTS

Figure 1:
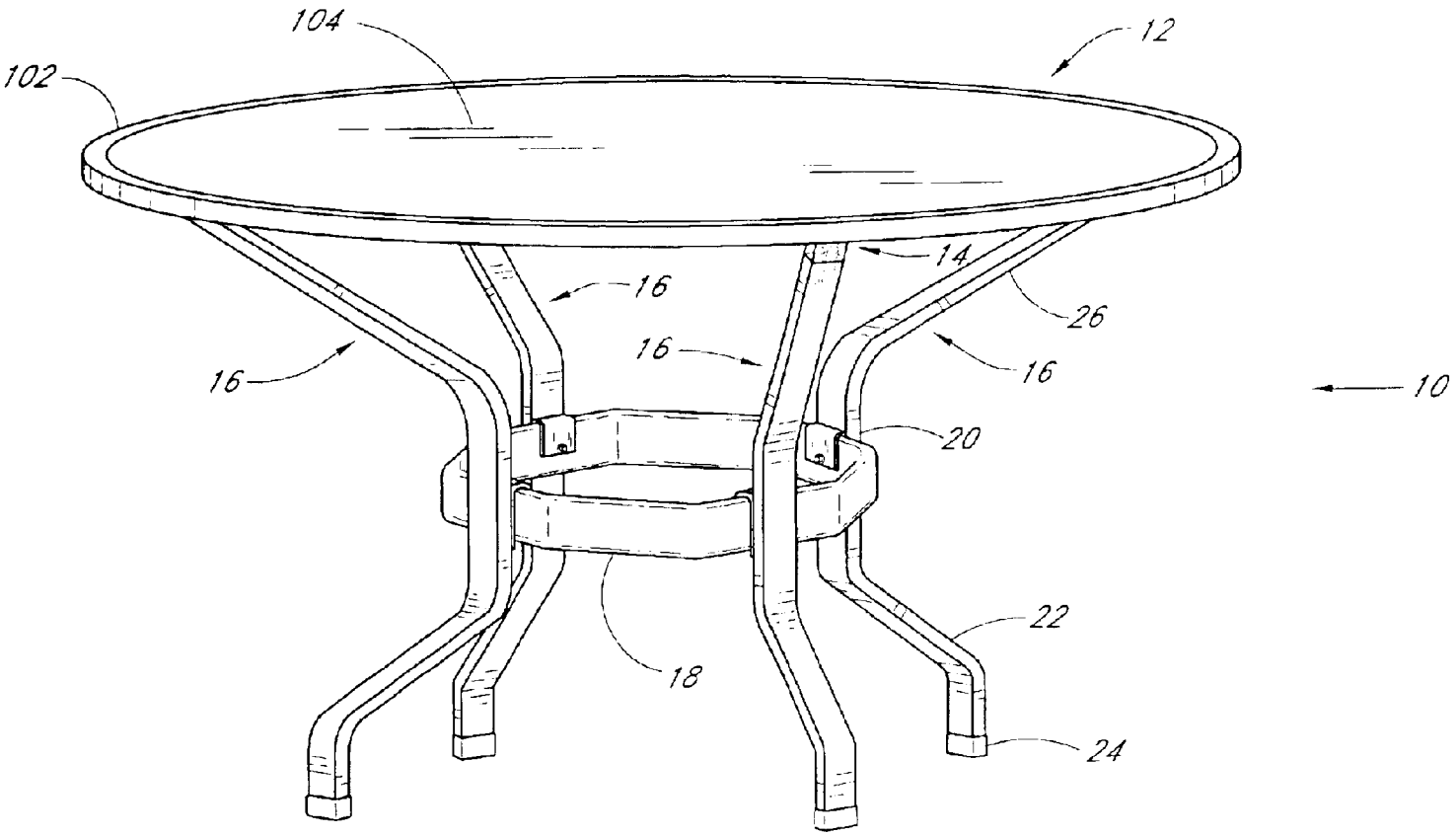
FIG. 1 is a perspective view of a fully assembled knock-down table according to the present invention.
Figure 2:
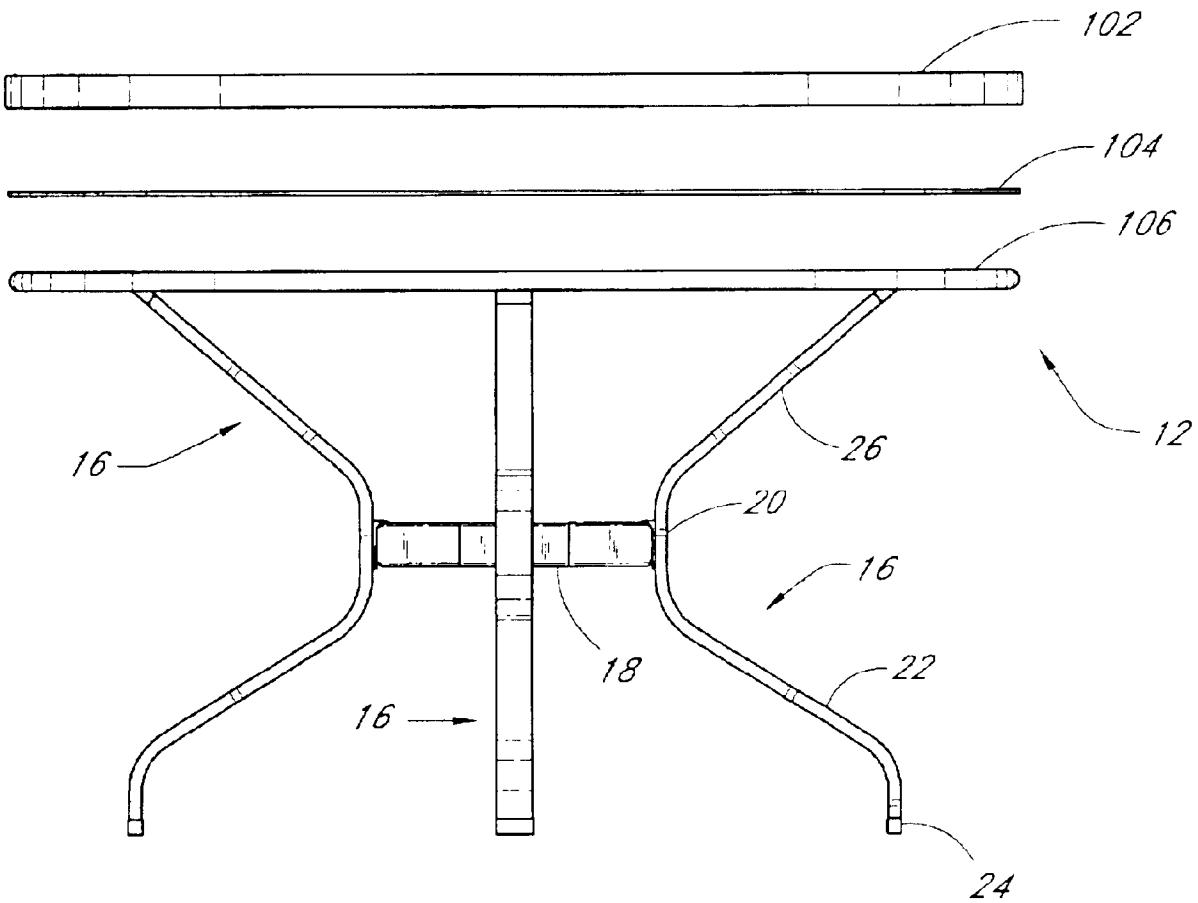
FIG. 2 is a side view illustrating the component parts of the table top.
Figure 3:
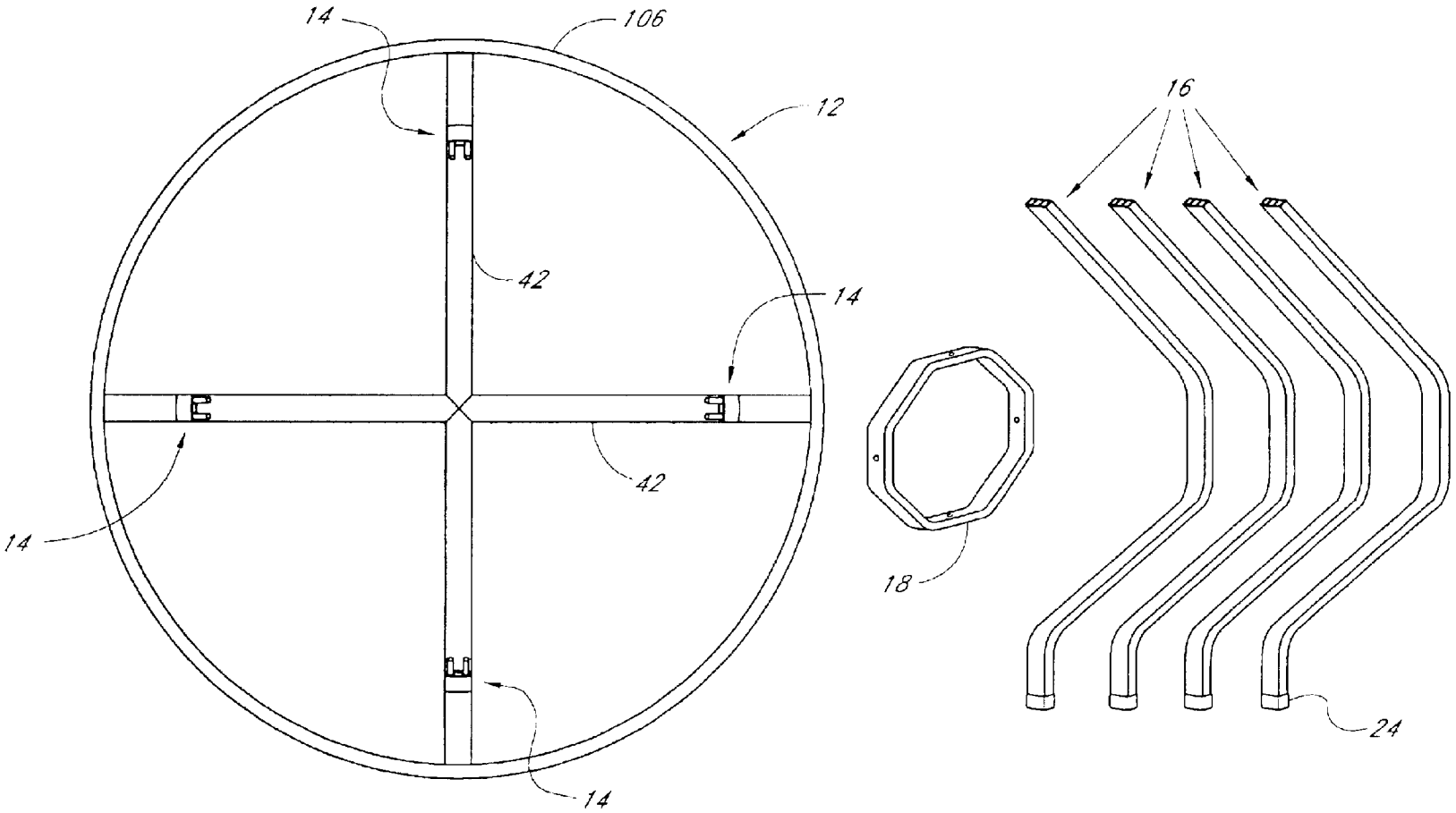
FIG. 3 is a perspective view showing the table disassembled for transportation or storage.

FIGS. 1–3 illustrate a preferred embodiment of a knock-down table 10 in accordance with the present invention. The knock-down table includes, generally, a horizontal table top 12, a leg assembly comprising a plurality of elongated legs 16, a plurality of coupling members 14 mounted on the bottom side of the table top, and a brace 18 for rigidly interconnecting each of the legs together. As best illustrated in FIG. 3, the knock-down table of the present invention may be advantageously disassembled and conveniently packaged into a substantially flat configuration for transportation or compact storage.

As shown in FIG. 2, the table top 12 has a substantially flat shape and is preferably constructed from component parts. The first component of the table top is a top ring 106 provided with two supports (shown in FIG. 3 as 42) that extend across the diameter of the ring 106. The second component of the table top is a surface member 104 that rests on the top ring 106 and supports 42 thereby providing the primary surface of the table top 12. The surface member 104 typically has a thickness of ¼" to ½" and may be made of glass, acrylic or any other suitable material. The third component of the table top is a flexible rim 102, typically formed of plastic or vinyl, that encircles the periphery of the top ring 106 and the surface member 104. Due to the component nature of the table top, the surface member 104 may be replaced by the user with a different color, material or design as desired for a particular function. Furthermore, the surface member may be replaced if damaged or broken without requiring the user to purchase an entire new table.

Still referring to FIGS. 1–3, the leg assembly preferably comprises four legs, however, it will be appreciated that the leg assembly may comprise any number of legs capable of supporting the table top in a stable manner. Each leg is an elongated member having an outwardly inclined upper portion 26, an outwardly inclined lower portion 22, and a vertical intermediate portion 20. The lower end of each leg is preferably provided with a cap fitting 24 made of a hard durable plastic that rests on the ground and protects against skidding or scratching. The legs may be of any desired configuration, however, each leg is preferably a substantially hollow structure having a generally rectangular cross-section. When attached to the table top, the longer sides of the rectangular legs face inwardly and outwardly. The legs are preferably extruded from an aluminum alloy or other suitable metal and are then formed into the desired shape. Alternatively, the legs may have any other cross-section known to those of skill in the art.

Figure 5:
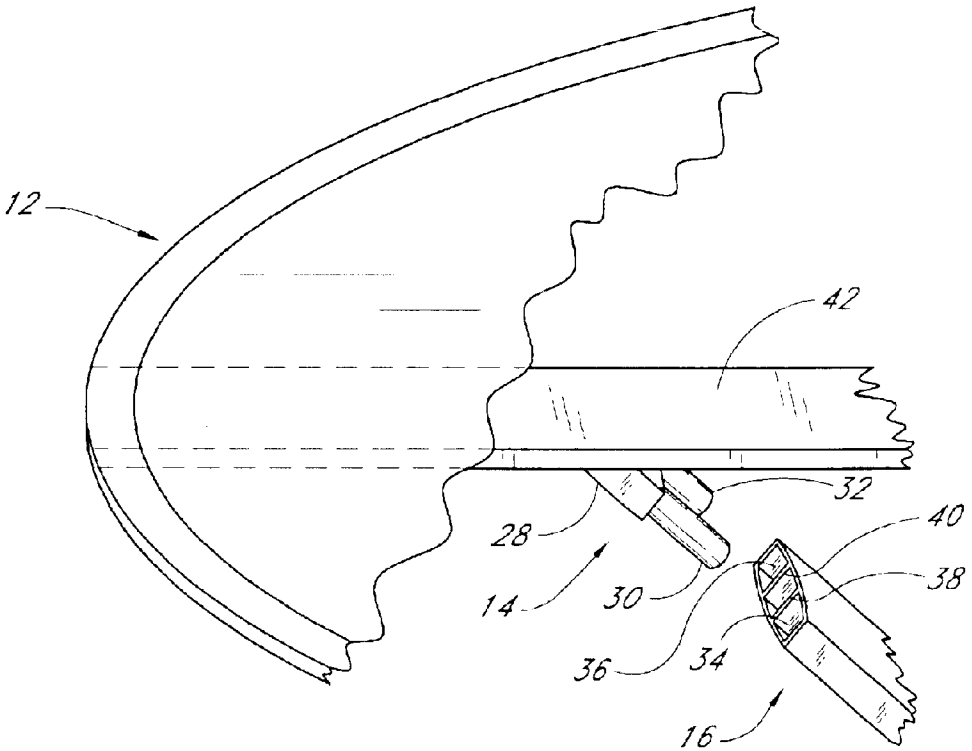
FIG. 5 is a perspective view of the coupling member of FIG. 4 and the top end of an elongated leg formed with sockets for receiving the pins.
Figure 4:
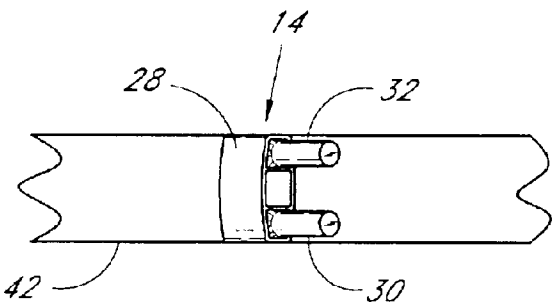
FIG. 4 is an enlarged view of a coupling member attached to a support comprising a pair of pins for insertion into a table leg.

Referring now to FIGS. 4–5, the table 10 includes a plurality of coupling members 14 projecting downwardly and inwardly from the bottom side of the table top 12. The coupling members 14 are preferably welded to the bottom side of the supports 42 or may be affixed by other suitable means such as the ring 106. In a first preferred embodiment, each coupling member 14 comprises a projection 28 and a pair of cylindrically shaped pins 30, 32 extending from the projection in a parallel configuration. In modifications of this embodiment, the number of pins and the pin cross-sections may be varied.

The substantially hollow inner portion of each leg is preferably formed with ribs 38, 40 that provide the leg with excellent structural integrity. The ribs also advantageously define sockets 34, 36 for slidably receiving the pins 30, 32 on the coupling members 14. When two pins are used for each leg, the legs are prevented from rotating relative to the table top. The pins 30, 32 preferably slide into the sockets 34, 36 in a snug friction-fit relationship.

Figure 7:
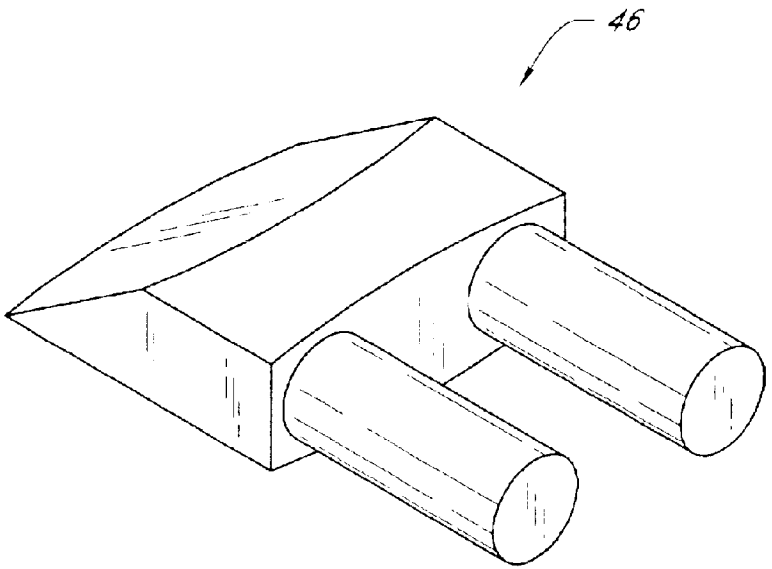
FIG. 7 is an enlarged perspective view of a coupling member that is die-cast as a solid piece.
Figure 6:
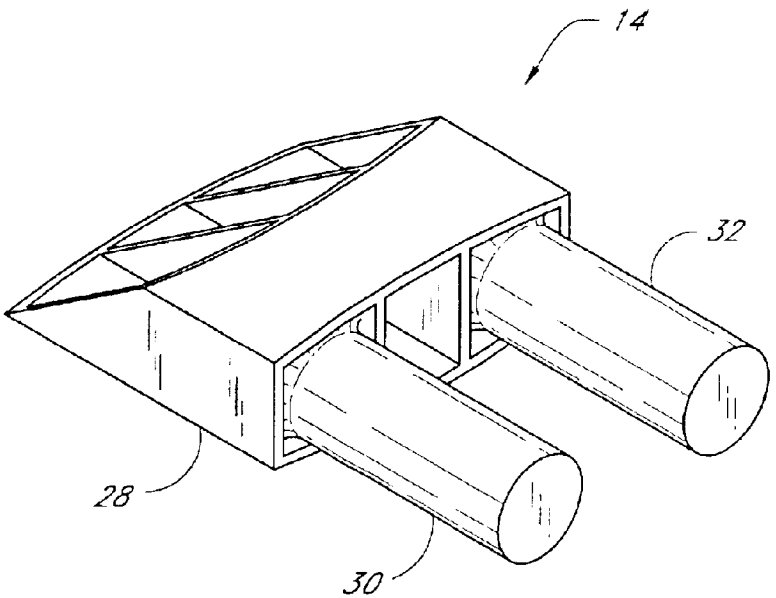
FIG. 6 is an enlarged perspective view of a coupling member whereby the pins are welded into the base portion.

FIGS. 6–7 illustrate preferred embodiments of the coupling members. In the preferred embodiment of a coupling member 14 shown in FIG. 6, each projection 28 is formed of substantially the same construction and cross-section as the legs 16 and hence can be conveniently cut from the same extrusion as the legs. The pins 30, 32 are welded into the sockets 34, 36 in the projection 28. In another preferred embodiment shown FIG. 7, each coupling members is die-cast as a single solid piece 46. In either case, when a coupling member 14 is attached to a support on the table top, the pins 30, 32 preferably extend downwardly and inwardly at an angle of about 45 degrees relative to the horizontal plane of the table top. Alternatively, the coupling members may be integral with their support structure.

Figure 8:
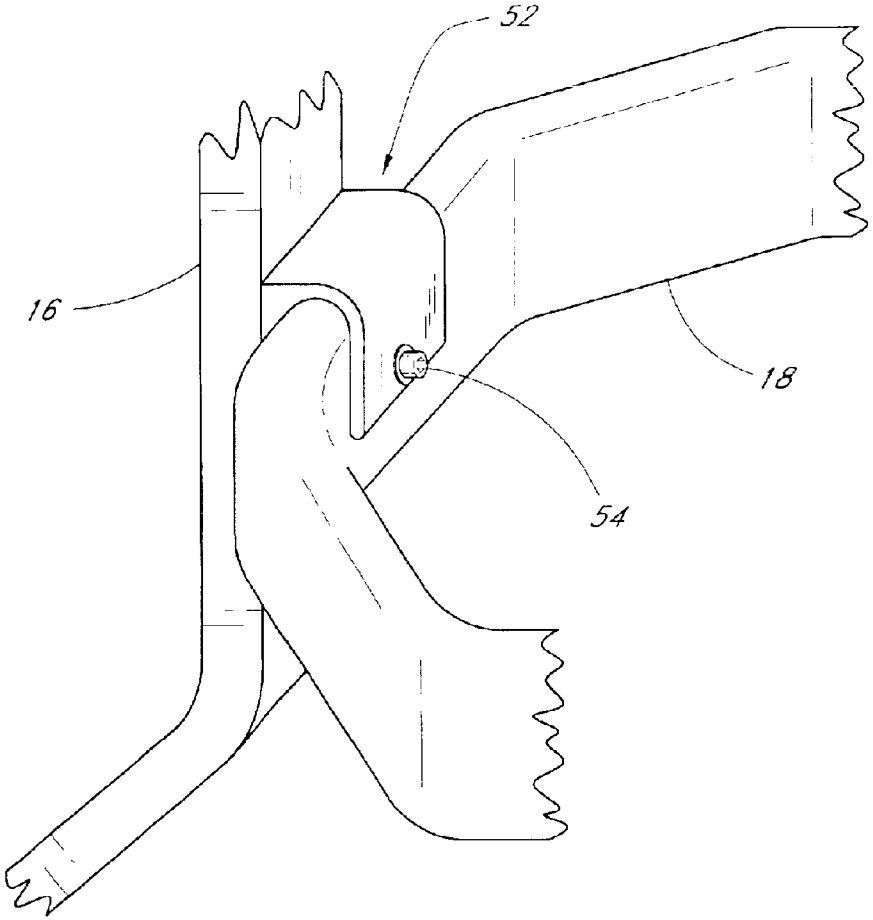
FIG. 8 is a perspective view illustrating how the brace is attached to each leg.
Figure 10:
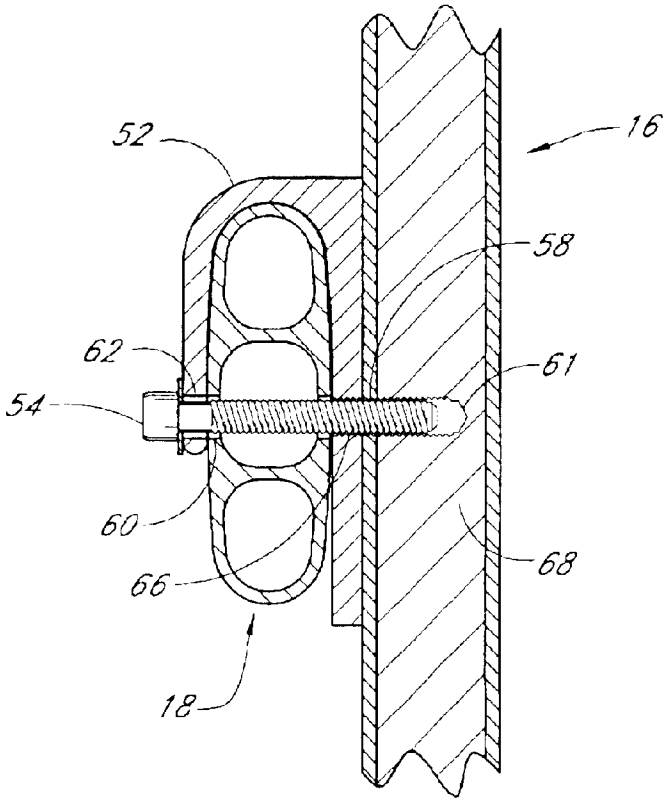
FIG. 10 is a cross-sectional view showing the bolt inserted through the U-shaped bracket and brace.
Figure 9:
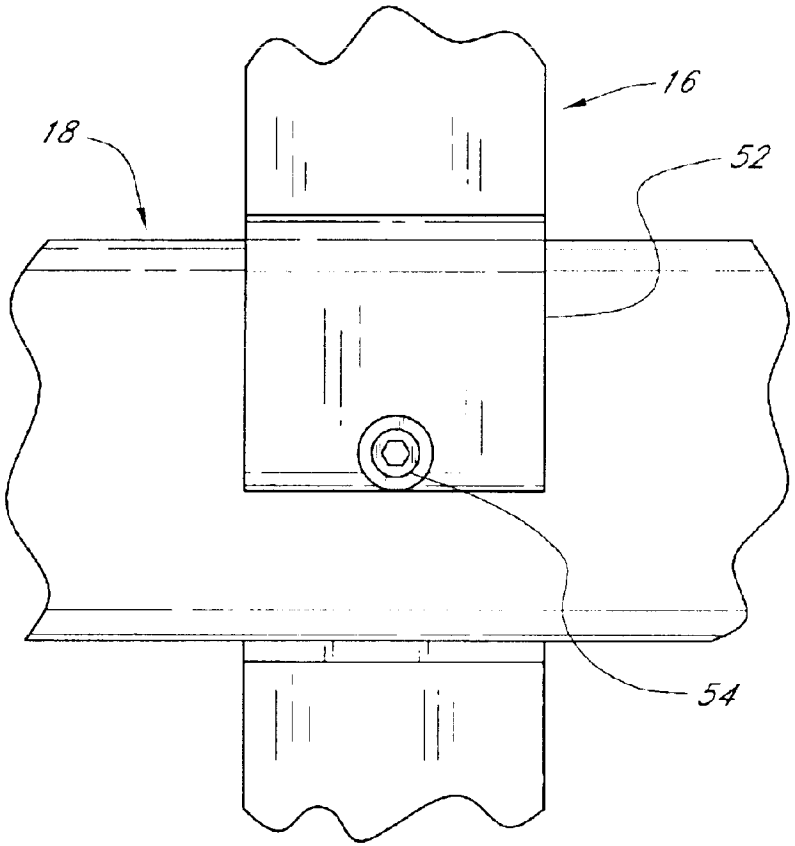
FIG. 9 is a side view illustrating the location of the bolt with respect to the leg and brace.

Referring now to FIGS. 8–10, U-shaped brackets 52 are preferably mounted on the inner surface of each leg 16 with the open end of the bracket facing downward. The brackets are attached to the legs by welding or other suitable means. A ring-shaped brace 18 is inserted into the open end of each bracket 52 for interconnecting each of the legs 16. The brace 18 may be of any desired configuration, however, the brace is preferably a substantially hollow structure having a rectangular cross-section.

A bolt 54, such as, for example, an allen bolt, is used to securely couple the brace 18 to each bracket 52 (and therefore to each leg 16). As best illustrated in FIG. 10, the bolt 54 extends through a first hole 62 in the bracket 52, through a hole 60 in the brace, through a second hole 66 in the bracket 52 and into a hole 58 formed in the wall of the leg 16. The second hole 66 in the bracket 52 is preferably formed with threads for positively engaging the bolt and preventing the bolt from inadvertently backing out. FIG. 9 illustrates a view of the leg 16, brace 18 and bolt 54 looking outward from a location underneath the table. FIG. 10 illustrates a cross-sectional view showing a bolt 54 inserted through a bracket 52 and brace 18 and into a leg 16. Of course, the bolt may be held in place in any of a number of alternative ways. For example, any one of the holes 58, 60, 62 may be threaded.

A plastic insert 68 is preferably provided in the vertical intermediate portion 20 of each leg 16. The insert 68 is inserted between the two ribs 38, 40 to provide the leg 16 with additional structural support and also to provide a threaded seat 61 for the bolt 54. The insert 68 is preferably inserted after the leg 16 is extruded but before it is shaped. The insert 68 extends into at least one of the outwardly inclined portions 16, 22 of the leg 16. When the extruded leg is shaped, the insert is shaped with the leg thereby causing it to be fixed in location within the leg.

Figure 12:
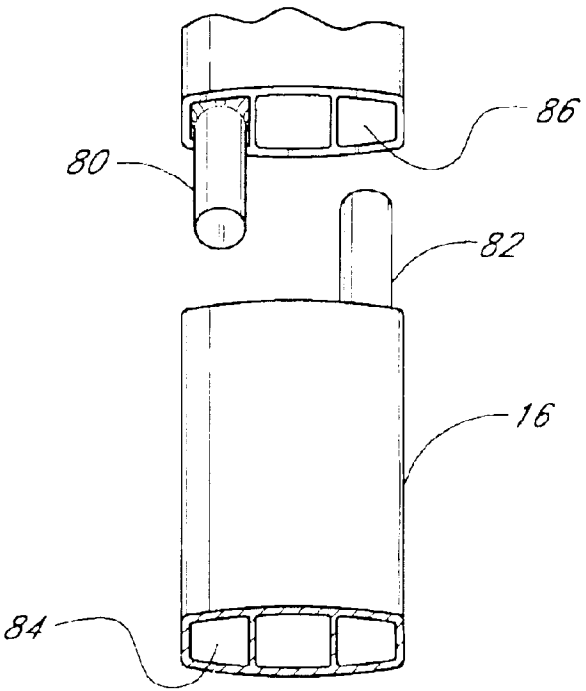
FIG. 12 is a perspective view showing another embodiment of the coupling mechanism whereby one pin is located on the table top and one pin is located on a leg.
Figure 11:
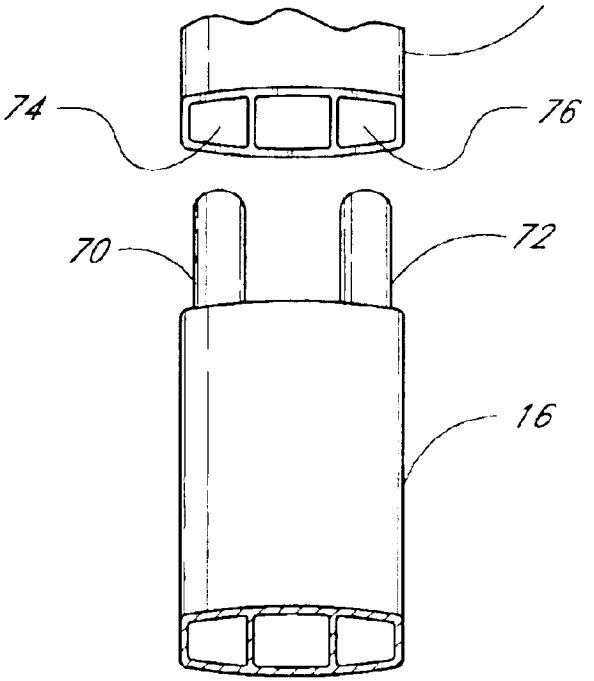
FIG. 11 is a perspective view showing another embodiment of the coupling mechanism whereby the pins are located on the legs and the sockets are located on the table top.

FIGS. 11–12 illustrate examples of modifications of the present invention whereby the pins and sockets used to attach the legs to the table top are configured in alternative arrangements. FIG. 11 illustrates a modification in which pins 70, 72 are welded into the sockets in the upper end of the leg 16. In this modification, the legs are attached to the table top 12 by inserting the pins 70, 72 into sockets 74, 76 formed in the projection 28 on the bottom surface of the table top 12. FIG. 12 illustrates another modification in which a first pin 80 is welded into the projection 28 and a second pin 82 is welded to the leg 16. The first pin 80 is inserted into the socket 84 formed in the leg 16, and the second pin 82 is inserted into the socket in the projection 28 in the table top 12. These modifications are shown for purposes of illustration, however, various other pin shapes and configurations can be used for coupling the legs to the table top without departing from the scope or spirit of the invention.

Figure 13B:
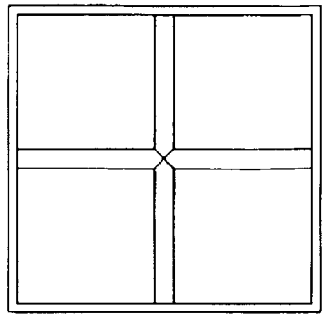
Figure 13B:
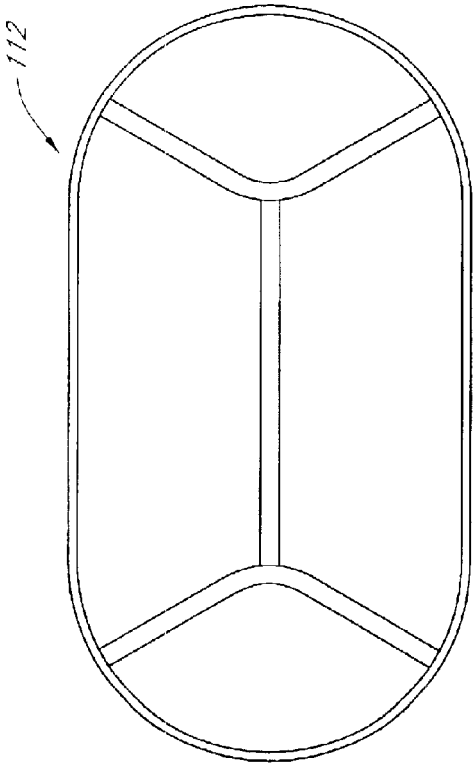
Figure 13A:
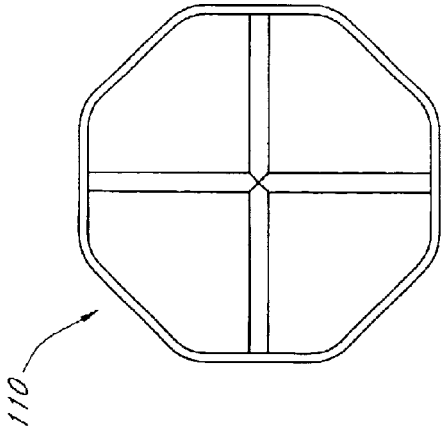

It should be appreciated that alternative table top shapes may also be used with the present invention. For example, other shapes that will work equally well with the present invention include, but are not limited to, the octagonal table top 110 shown in FIG. 13A, the rounded rectangular table top 112 shown in FIG. 13B, and the square table top 114 shown in FIG. 13C. It should also be appreciated that the table top may be formed of one piece construction made of a suitable material, such as an aluminum alloy without departing from the spirit or scope of the invention. A single leg assembly may be compatible with more than one table top. For example, a single leg assembly may be manufactured to be compatible with a round, octagonal or square table top. This feature advantageously allows the user to change table top configurations without purchasing an entire new table.

Figure 14:
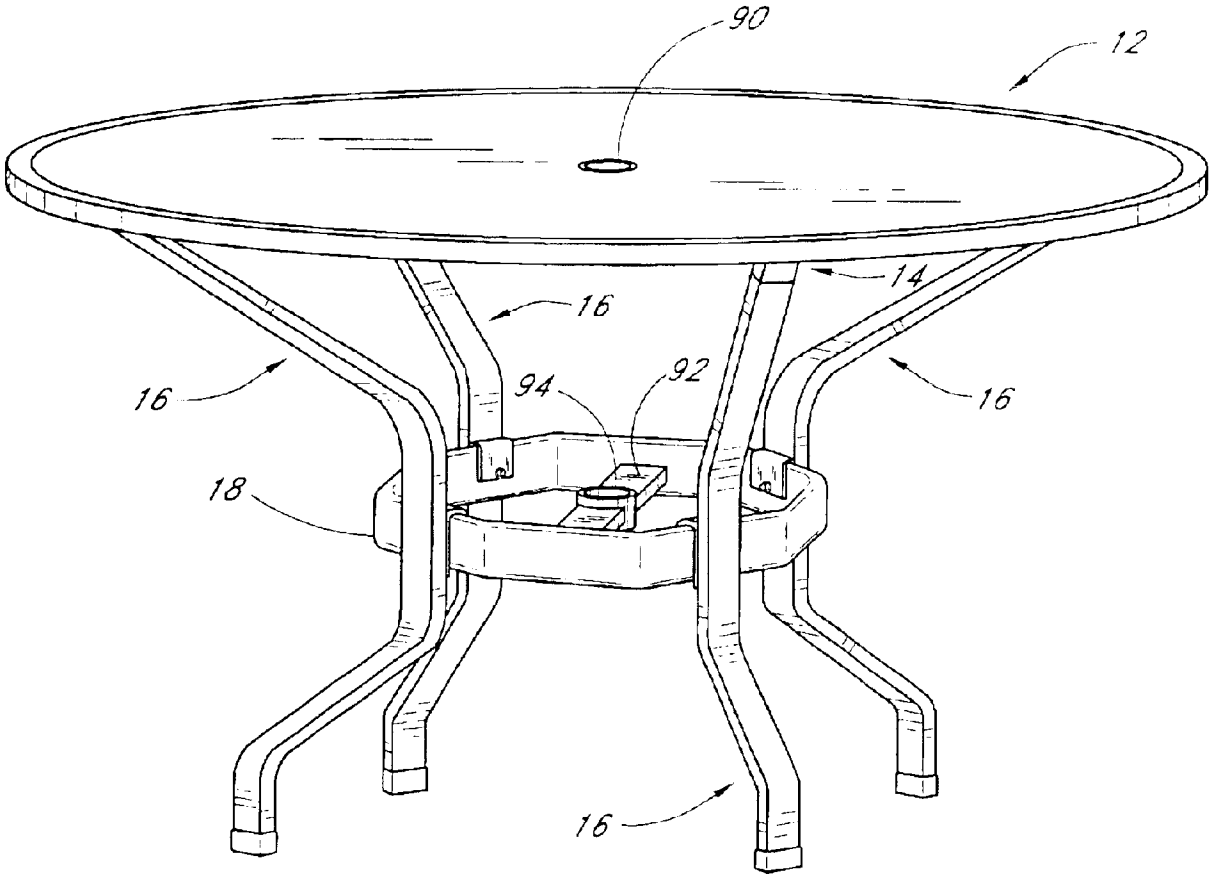
FIG. 14 is a perspective view illustrating another embodiment of the knock-down table further comprising structural components for holding an umbrella.
Figure 15:
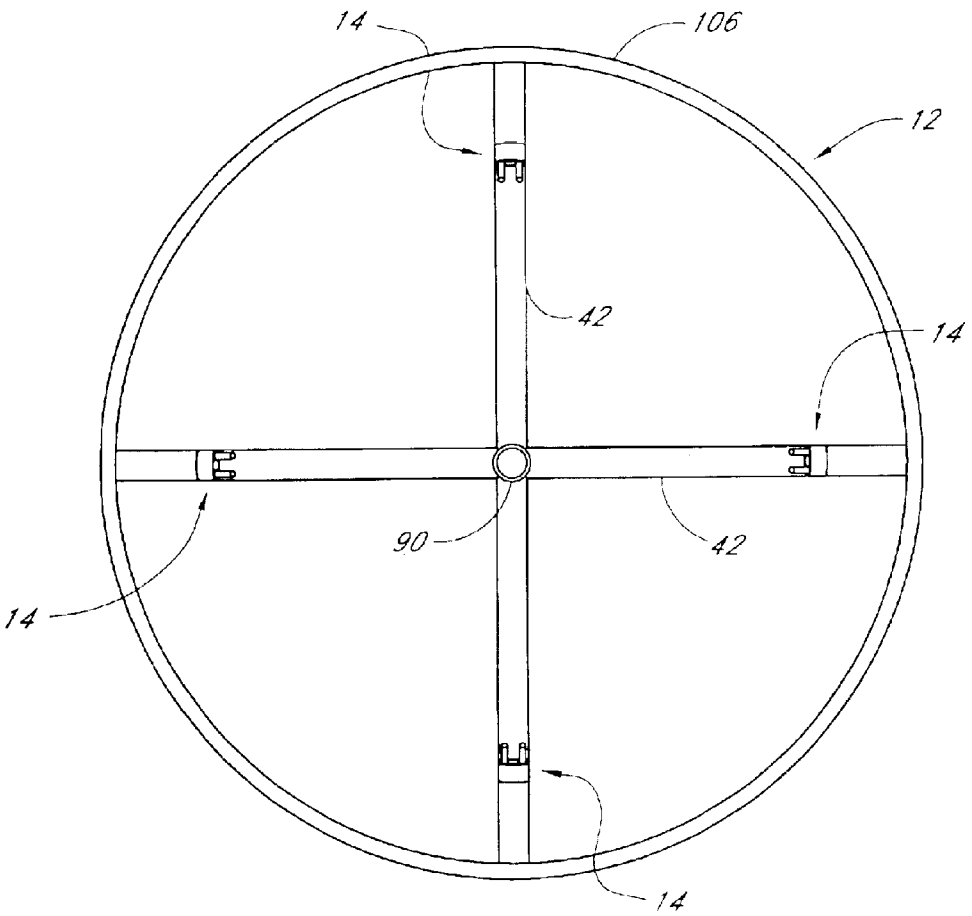
FIG. 15 is a view from underneath the table top of FIG. 14 showing the hole in the center.

In a variation of the present invention, the knock-down table may be manufactured for use with an umbrella as illustrated in FIG. 14. In this modification, a central hole 90 is formed in the center of the table top 12. An umbrella support member 92 extends across the diameter of the brace 18. A hole 94 is formed in the center of the umbrella support member 92. The shaft of the umbrella is inserted through the central hole 90 in the table top and through the hole 94 in the umbrella support member 92. As shown in FIG. 15, the supports 42 of the table top 12 are joined in the center to form a hole for supporting the umbrella shaft.

The primary components of the present invention (except for the surface member and flexible rim) are preferably made of a lightweight, non-rusting aluminum alloy, such as 6061. Because aluminum is lightweight and the components are generally hollow in construction, the table can be easily lifted while in the fully assembled configuration. Aluminum is resistant to corrosion and therefore the table can be left outdoors for extended periods without rusting or diminishing in aesthetic value. Aluminum is also very durable and therefore the table can withstand impacts without incurring significant damage and will have a very long design life.

In a preferred embodiment, different components of the invention may all be formed with identical cross-sections.

Therefore, the table legs, coupling members, supports and brace may all be cut from the same extrusion and then shaped into the desired configuration. This design commonality advantageously provides the manufacturer with cost savings that can be passed onto the consumer.

An exemplary method of assembling the table will now be described with reference to the preferred embodiments and figures described above. With the table in the disassembled configuration as illustrated in FIG. 3, the table top 12 is laid on the ground in an upside down configuration and each leg 16 is attached to the table top 12. The legs are attached by inserting the pins 30, 32 into the sockets 34, 36 formed in the top ends of the legs 16 as shown in FIG. 5. After each leg 16 is attached to the table top 12 in this manner, the brace 18 is placed into each of the U-shaped brackets 52 provided on the legs 16. Bolts 54 are then inserted through the U-shaped brackets 52 and brace 18 to securely couple the legs to the brace as shown in FIGS. 8–10. The table 10 is then placed upright such that the bottom end of each leg rests on the ground as shown in FIG. 1. The surface member 104 is then placed onto the supports 42 and the surface ring 106. The upper rim 102 is then placed over the surface member and top ring 106 as shown in FIG. 2 to complete the assembly of the table.

With the legs attached to the table top and rigidly interconnected together with the brace, the table provides a very sturdy and rigid structure. Due to the inward inclination of the projections, the table top cannot be removed from the leg assembly while the legs are interconnected by the brace. Therefore, the entire table may be moved by lifting only the table top portion without danger of the table top becoming separated from the leg assembly. Because the table is made of lightweight materials, the table can be easily moved in the fully assembled configuration.

The table may be easily disassembled simply by turning the table back upside down, removing the bolts, removing the brace, and detaching each of the legs from the table top.

From the foregoing, it will be appreciated that the outdoor table of the present invention is very easy to assemble and has excellent structural integrity. Due to the minimal number of components and ease of use, the table may be quickly assembled and disassembled for transportation and storage. In addition, the outdoor table of the present invention is very versatile and can be used in a broad range of applications at home or in a commercial establishment. The invention is primarily designed for outdoor use, however, this same design works equally as well with an indoor table.

While a particular form of the invention has been illustrated and described, it will also be appreciated that various additional modifications can be made without departing from the spirit and scope of the invention.

What is claimed is:

1. A collapsible table comprising:

a table top;

a plurality of coupling members mounted on a bottom side of said table top;

a plurality of elongated legs, each of said legs having a top end extending upwardly and outwardly for slidable attachment to one of said coupling members; and a brace for interconnecting said legs and maintaining said legs in a substantially rigid arrangement, said brace being attachable along an inner surface of each of said legs;

wherein each of said coupling members comprises at least one pin extending substantially downwardly and inwardly from a bottom side of said table top and said top end of said legs are formed with at least one socket for receiving a respective one of said pins.

2. A collapsible table comprising:

a table top;

a plurality of coupling members mounted on a bottom side of said table top;

a plurality of elongated legs, each of said legs having a top end adapted for releasably coupling to one of said coupling members; and a brace for interconnecting said legs and maintaining said legs in a substantially rigid arrangement;

wherein said table top further comprises a top ring and at least one support spanning across center portion of said top ring, said coupling members being mounted to a bottom side of said at least one support, a surface member resting on said top ring and said at least one support member, and an annular rim covering a peripheral edge of said top ring and said surface member.

3. A collapsible table comprising:

a table top;

a plurality of coupling members mounted on a bottom side of said table top;

a plurality of elongated legs, each of said legs having a top end adapted for releasably coupling to one of said coupling members; and a brace for interconnecting said legs and maintaining said legs in a substantially rigid arrangement;

wherein each of said legs is extruded as a substantially hollow member formed with one or more internal ribs.

4. The table of claim 3, wherein said internal ribs define sockets in said top end of said legs for slidably receiving at least one pin of said coupling members.

5. The table of claim 3, wherein said legs are shaped with a substantially rectangular cross-section.

6. The table of claim 3, wherein said brace has substantially the same cross-section as said legs.

7. The table of claim 6, wherein said table top includes lateral supports having substantially the same cross-section as said legs.

8. The table of claim 1, further comprising brackets on each of said legs for receiving said brace.

9. A collapsible table comprising:

a table top;

a plurality of coupling members mounted on a bottom side of said table top;

a plurality of elongated legs, each of said legs having a top end extending upwardly and outwardly for slidable attachment to one of said coupling members; and a brace for interconnecting said legs and maintaining said legs in a substantially rigid arrangement, said brace being attachable along an inner surface of each of said legs;

wherein each of said legs is extruded to provide a hollow interior region and further comprising one or more inserts placed within said hollow interior region of each leg for providing additional structural support.

10. A collapsible table comprising:

a table top;

a plurality of pins projecting substantially downwardly and inwardly from said table top, each of said pins having a substantially constant cross-sectional profile;

a plurality of elongated legs, each of said legs having a top end formed with sockets for slidably receiving said pins; and a brace for interconnecting said legs and maintaining said legs in a substantially rigid arrangement.

11. The table of claim 10, further comprising a bracket mounted on each of said legs for receiving said brace.

12. A collapsible table comprising:

a table top;

a plurality of elongated legs, each of said legs including at least one pin, said at least one pin extending from said leg, each of said pins having a substantially constant cross-sectional profile;

a plurality of sockets formed in a bottom side of said table top for slidably receiving said pins; and a brace for interconnecting said legs and maintaining said legs in a substantially rigid arrangement.

13. The table of claim 12, further comprising a bracket mounted on each of said legs for receiving said brace.

14. A method of manufacturing a collapsible table comprising the steps of:

providing a table top;

attaching a plurality of pins to a bottom side of said table top, said pins extending downwardly and inwardly relative to a horizontal plane of said table top, each of said pins having a substantially constant cross-sectional profile;

extruding a plurality of elongated legs formed with sockets for receiving said pins;

shaping said legs such that said legs are configured to slidably receive said pins; and providing a brace for securement to each of said legs at a location between a top end of said legs and a bottom end of said legs.

15. The method of claim 14 further comprising the step of:

attaching a bracket to each of said legs for receiving said brace.

16. A collapsible table comprising:

a table top including a top rim and at least one support spanning across said top rim, said table top further including a surface member resting on or adjacent to said top rim and said at least one support;

a plurality of coupling members mounted on a bottom side of said at least one support at a location spaced inwardly from said top rim;

a plurality of elongated legs, each of said legs having a top end extending upwardly and outwardly for slidable attachment to one of said coupling members; and a brace for interconnecting said legs and maintaining said legs in a substantially rigid arrangement.

17. The collapsible table of claim 16, wherein the top rim is a circle.

18. The collapsible table of claim 16, wherein the top rim is an oval.

19. The collapsible table of claim 16, wherein the top rim is a polygon.

20. The collapsible table of claim 16, wherein said support spans a center portion of said table rim.

* * * * *

UNITED STATES PATENT AND TRADEMARK OFFICE

CERTIFICATE OF CORRECTION

PATENT NO. : 6,877,443 B2 
DATED : April 12, 2005
INVENTOR(S) : Richard Rivera, Guillermo Rodriguez and Moi V. Bui It is certified that error appears in the above-identified patent and that said Letters Patent is hereby corrected as shown below:

Title page,
Item [75], Inventors, second inventor's first name should read -- Guillermo --.

Signed and Sealed this

Thirteenth Day of December, 2005

JON W. DUDAS
*Director of the United States Patent and Trademark Office*